United States Patent [19]

Kidaloski et al.

[11] Patent Number: 4,685,426

[45] Date of Patent: Aug. 11, 1987

[54] MODULAR EXHAUST GAS STEAM GENERATOR WITH COMMON BOILER CASING

[75] Inventors: Raymond G. Kidaloski, Canal Fulton; Harry S. Olinger; Stephen A. Bryk, both of Akron, all of Ohio

[73] Assignee: The Babcock & Wilcox Company, New Orleans, La.

[21] Appl. No.: 859,550

[22] Filed: May 5, 1986

[51] Int. Cl.[4] ..... F22B 25/00

[52] U.S. Cl. ..... 122/214; 122/7 R; 122/470; 122/510

[58] Field of Search ..... 122/7 R, 209 R, 214, 122/223-224, 225 R, 225 A, 226-227, 235 D, 235 R, 328, 347-348, 420-421, 444, 451 S, 468, 470, 476-477, 483, 510-511, DIG. 11, 6 R, 6 A

[56] References Cited

U.S. PATENT DOCUMENTS

| | | | |
|---|---|---|---|
| 3,358,650 | 12/1967 | Olson et al. | 122/510 X |
| 3,376,859 | 4/1968 | Miszak | 122/235 A |
| 3,453,087 | 7/1969 | Herp, Jr. et al. | 122/510 X |
| 3,769,795 | 11/1973 | Rostrom | 122/7 R X |
| 3,842,904 | 10/1974 | Gardenier | 122/7 R X |
| 4,286,549 | 9/1981 | Eisinger | 122/510 |
| 4,466,241 | 8/1984 | Inui et al. | 122/7 R X |
| 4,572,110 | 2/1986 | Haeflich | 122/7 R |

FOREIGN PATENT DOCUMENTS

| | | | |
|---|---|---|---|
| 932104 | 5/1982 | U.S.S.R. | 122/235 D |

*Primary Examiner*—Albert J. Makay
*Assistant Examiner*—Steven E. Warner
*Attorney, Agent, or Firm*—Robert J. Edwards; Michael L. Hoelter

[57] ABSTRACT

A shop assembled modular steam generator wherein each module includes top supported pressure parts, casing, and a frame structure. These modules are readily transported to a remote construction site and interconnected. Each of the superheater, high pressure boiler, intermediate pressure boiler, low pressure boiler, and economizer sections of the generator comprise separate center and end modules whose casings are joined to provide a gas tight flow path around the pressure parts.

18 Claims, 15 Drawing Figures

MODULAR EXHAUST GAS STEAM GENERATOR WITH COMMON BOILER CASING

FIELD OF THE INVENTION

This invention relates in general to the construction of exhaust gas steam generators and, more particularly, to the provision of a shop-assembled combination of top-supported pressure parts, casing, and frame structure in a module that can be readily transported to a remote job site where a plurality of the modules are connected to form a single steam generator.

BACKGROUND OF THE INVENTION

Traditionally, steam generators have been designed with independent pressure parts that are bundled and enclosed in elaborate, engineered, shipping frames for shipping and handling. At the construction site, the pressure parts are set on a field-erected operating frame and the shipping frames are removed and discarded. The pressure parts are then enclosed by a field fabricated casing enclosure. Consequently, nearly all assembly as well as erection was accomplished in the field and this required the transportation and handling of a multitude of individual parts.

Additionally, such designs are typically bottom-supported designs which means that pressure parts are supported from lower headers that, in turn, rest upon upright columns positioned beneath the headers. Bottom-supported units require elaborate expansion hardware at the top of the unit to compensate for the large expansion differential that occurs between the pressure and non-pressure parts.

With a modular design of steam generator components, it is possible to maximize shop assembly and minimize field erection assembly and its associated higher costs. Current modular designs feature independent parallel flow casings having inner steam/water cooled heating surfaces and these independent casings result in separate parallel gas flow streams through the various modules. These separate flow streams prevent the gas from mixing which would otherwise result in desirable uniform gas temperatures. Consequently, considerable gas temperature variations may exist between these separate flow paths which adversely affect the heat transfer and temperature balance of the steam generator.

SUMMARY OF THE INVENTION

In accordance with the invention, a top-supported steam generator module is provided that has a generally rectangular frame including parallel, vertical corner supports, upper and lower supporting frames attached to the corner supports, and midspan support bracing that extends horizontally and diagonally between the corner supports. A casing is provided that closes at least the upper and lower ends of each module, with outer or end modules also having at least one side closed by the casing. Means are provided for supporting the pressure parts, including a tube bank and headers, from the upper end of the module.

In accordance with a preferred embodiment of the invention, the rectangular outer or end modules are provided with two corner supports which are tubular and two corner supports which are structural members such as W- or I-beams. Inner or center modules, intermediate the outer modules, are provided with four tubular corner supports.

A preferred feature of the invention is the provision of a midspan support for laterally supporting the elongated finned boiler tubes. This support consists of a series of adjacent circular tube sleeves supported on top of and secured to a series of parallel flat bars. The elongated finned tubes extend through these sleeves and the ends of the parallel bars are connected to bracing which in turn is secured to adjacent corner supports. These connections are configured so as to allow for expansion/contraction between the connecting members.

A still further preferred feature of the various embodiments of the invention is the provision of top supporting means, constituting the normal support means for substantially all of the weight of the tube bank. The top supporting means includes pairs of spaced lug plates connected to the upper header and a "T" shaped support intermediate the lug plates that is pin connected to these plates. The T-shaped member is in turn connected to the upper supporting frame.

DETAILED DESCRIPTION OF THE PREFERRED EMBODIMENT

Figure 1:
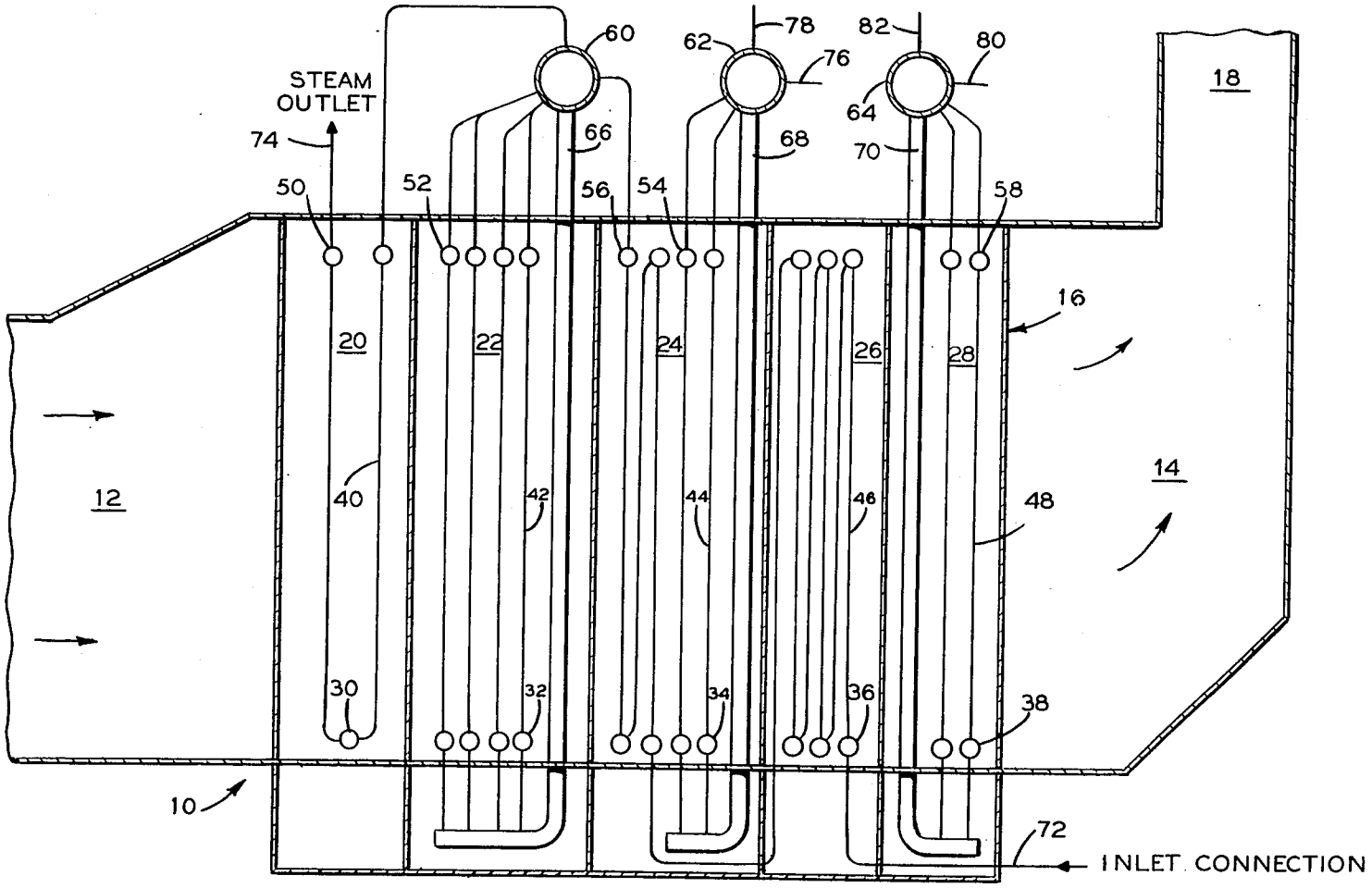
FIG. 1 is a side view, partially broken away, illustrating a waste heat steam generator embodying the modules according to the invention.

Referring initially to FIG. 1, a steam generator 10 is shown which is used for the recovery of waste heat from turbine exhaust gases. Steam generator 10 includes inlet duct 12 and outlet duct 14, a boiler section 16 interposed therebetween, and a stack 18. The steam generator illustrated is a single pass unit because the hot gases which enter inlet duct 12 and which are exhausted to the atmosphere through stack 18 pass once through boiler section 16.

Boiler section 16 is composed of a plurality of modules each having separate, distinct pressure parts which interconnect to define the boiler circuitry. The modules which comprise boiler section 16 include superheater module 20, high pressure boiler module 22, intermediate pressure module 24, economizer module 26, and low pressure boiler module 28.

Each of modules 20, 22, 24, 26, and 28 include, respectively, lower headers 30, 32, 34, 36 and 38, tube banks 40, 42, 44, 46, and 48, and upper headers 50, 52, 54, 56, and 58. Three of the upper headers, upper headers 52, 54, and 58, connect to high, intermediate, and low pressure steam drums 60, 62, and 64, respectively, each having one of downcomers 66, 68 and 70 connected thereto. One of economizer upper headers 56 also connects to high pressure steam drum 60, and one of superheater upper headers 50 connects to a steam line (not shown) for transporting this steam elsewhere.

As can be seen in FIG. 1, a portion of the economizer of steam generator 10 is located in intermediate pressure boiler module 24. Also, the pressure piping of superheater module 20 is U-shaped with the inlet to one of the upper headers 50 connected to the steam outlet of high pressure steam drum 60.

Each of the economizer sections of steam generator 10 incorporate upflow circuitry whereby the fluid flows from a lower header to an upper header through a series of finned tubes which comprise the tube banks. The fluid then flows from the top header down to the next bottom header via a large unfinned tube.

Three separate circuits and pressure levels are illustrated in FIG. 1 although this number is variable. The first circuit has a fluid inlet at economizer inlet connection 72 and a steam outlet at superheater outlet 74. The second circuit has a fluid inlet at intermediate pressure steam drum inlet connection 76 and a steam outlet at outlet connection 78. The third circuit has a fluid inlet at low pressure steam drum inlet connection 80 and a steam outlet at outlet connection 82.

Figure 2:
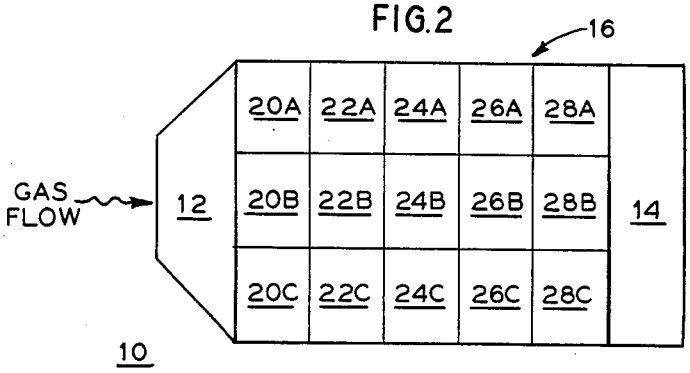
FIG. 2 is a schematic plan view of the steam generator of FIG. 1.

Referring now to FIG. 2, it can be seen that boiler section 16 of steam generator 10 is modular. Each of the high, intermediate, and low pressure boiler sections, superheater, and economizer portions of steam generator 10 include multiple modules A, B, and C. Thus, for example, high pressure boiler module 22 comprises end modules 22A and 22C and center module 22B. The same is true for modules 20, 24, 26, and 28. If desired, center module B may consist of one or more individual modules such that boiler section 16 may be as wide as desired. Additionally, each module A, B, and C is shop fabricated consisting of an open frame structure, pressure parts, and casing. This frame structure is generally rectangular, as shown, and consists of a skeletal framework of various support members. The frame structure is designed so that each module is self-contained for lifting, shipping, and erection purposes.

Figure 3:
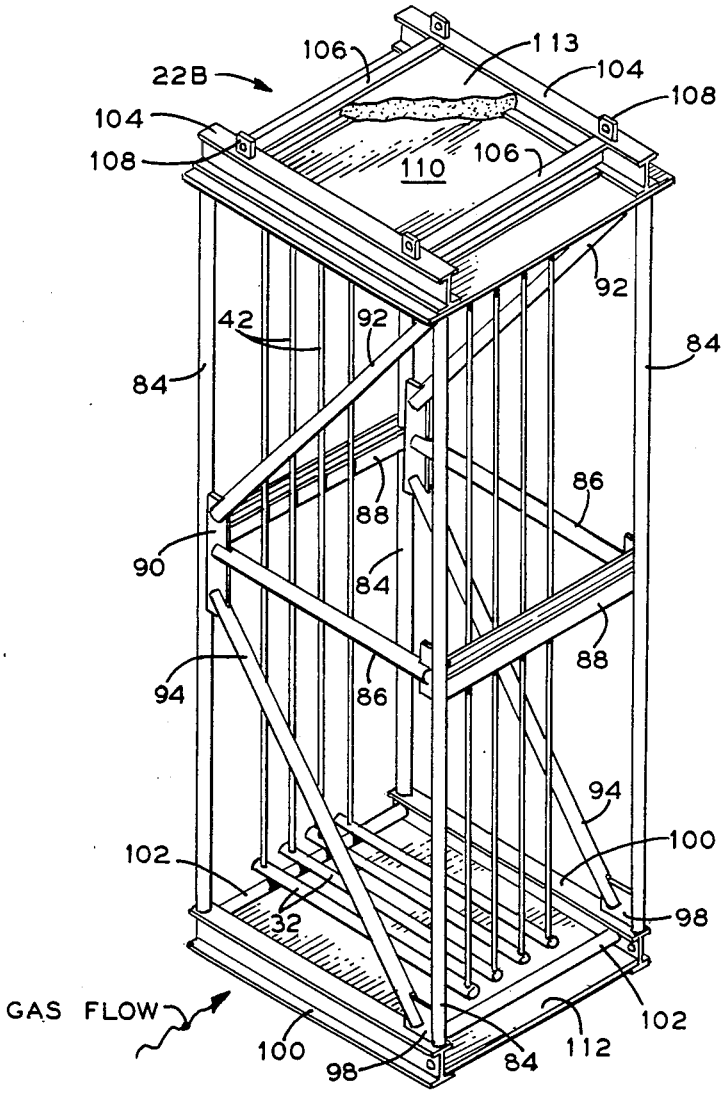
FIG. 3 is a perspective view of a center module according to the invention.

Referring now also to FIG. 3 there is shown center module B, such as 22B, whose rectangular frame structure, pressure parts, and casing are disclosed in greater detail. This rectangular frame structure includes four generally vertical tubular corner supports 84 that are braced at mid-span by horizontal mid-span supports 86 and 88. Tubular mid-span supports 86 extend perpendicular to the gas flow path while W or I beam mid-span supports 88 extend parallel to the gas flow path. Additionally, the flanges of W or I beam mid-span supports 88 are oriented to lie in parallel vertical planes. As shown, gusset plates 90 are secured at the mid-span of two of the vertical supports 84 and these gusset plates 90 also connect with one end of upper and lower diagonal tubular braces 92 and 94. The opposite end of tubular braces 92 and 94 connect to upper and lower gusset plates 96 and 98 respectively which are secured to the upper and lower ends of the other two vertical supports 84. Lower gusset plate 98 is also secured to the flanges of lower W or I beam girders 100. Structural tubing 102 interconnects these spaced girders 100 and this tubing 102 extends in a direction parallel to the gas flow path. The upper ends of the four vertical supports 84 are connected to upper W or I beam girders 104 which, in turn, are reinforced by intermediate girders 106 extending therebetween. Lifting lugs 108 are provided on girders 104 for lifting this central module B.

A top casing segment 110 is secured to the lower flanges of intermediate girders 106 above the pressure piping. Similarly, a bottom casing segment 112 is positioned between the parallel webs of lower spaced girders 100. Both casing segments 110 and 112 have insulation 113 along their outside surface but when the temperature in the module exceeds the allowable temperature of the carbon steel casing segment, (approximately 750° F.), the inner surface is also insulated. This inner insulation is faced with an inner cladding that protects the insulation from vapor within the boiler.

For each of modules 20, 22, 24, 26 and 28, their top casing segments 110 abut each other along their perimeter enabling them to be sealably secured together forming a gas tight upper surface for boiler section 16. The same abutting and securing operation occurs with respect to two sides of lower casing segment 112. The remaining two sides are sealably joined together by inserting a small casing segment (not shown) between the webs of adjacent girders 100 from different modules and sealing this segment to these girders. Thus, a continuous, gas tight, upper and lower casing surface is formed by the various modules.

The pressure piping of this typical center high pressure module 22B includes lower headers 32 and tube bank 42 which have a longitudinal direction generally perpendicular to the gas flow path. Upper header 52 (not shown in FIG. 3) is positioned underneath top casing segment 110.

Figure 4:
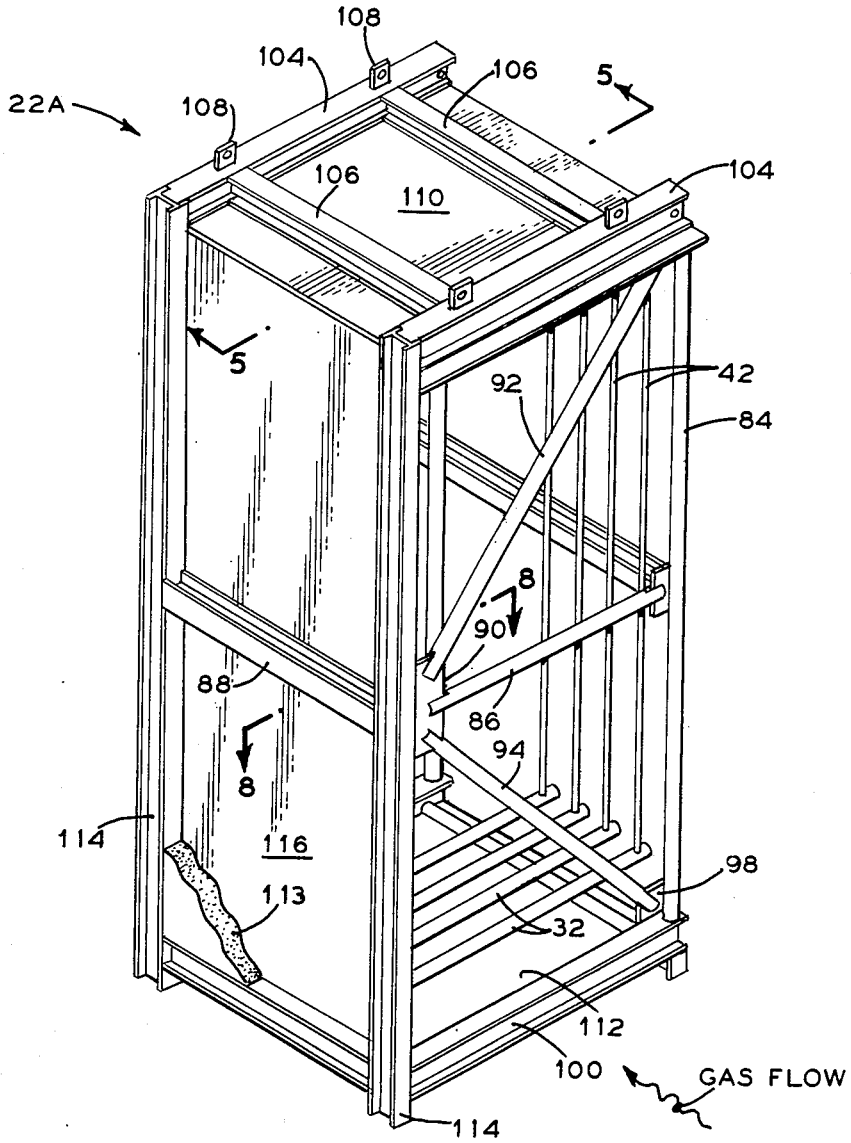
FIG. 4 is a perspective view of an end module according to the invention.
Figure 5:
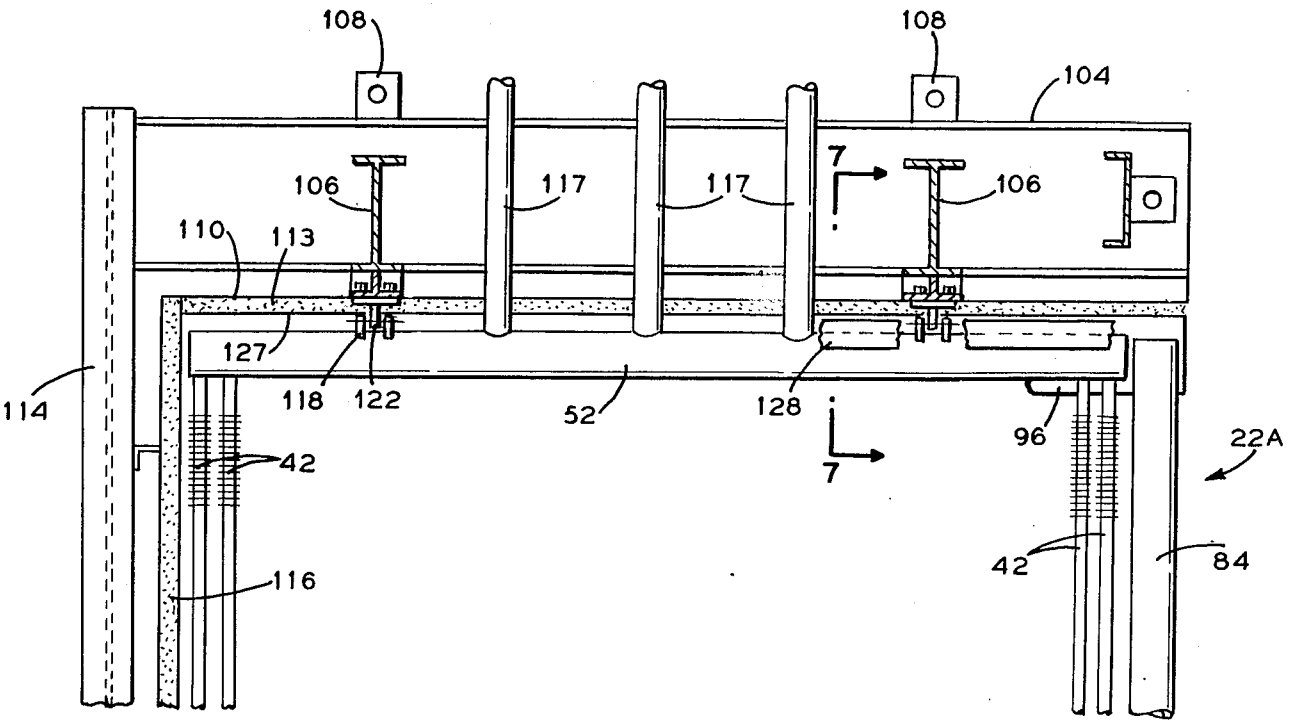
FIG. 5 is a sectional view, partially broken away, taken along Line 5—5 of FIG. 4 and illustrating the upper region of an end module.

Referring now also to FIGS. 4 and 5, an end module, such as high pressure boiler module 22A or 22C is illustrated. Riser tubes 117, as shown, extend about 6" above the top of upper W- or I-beam girders 104 and these tubes 117 connect between upper header 52 and high pressure steam drum 60. The rectangular skeletal frame structure of this module is similar to that for its corresponding center module B except that for the end modules, the outer two vertical supports 84 are replaced with outer vertical W or I beam girders 114. Additionally, a side casing 116 is interposed between these girders 114 and this side casing includes insulation 113 on its outer surface. The side casings 116 from adjacent modules are sealably secured together and to their respective top and bottom casing segments 110 and 112. Thus a continuous casing is provided around boiler section 116 which connects with inlet duct 12 and outlet duct 14. Other similar items, including pressure parts, retain their same reference numerals.

Figure 6:
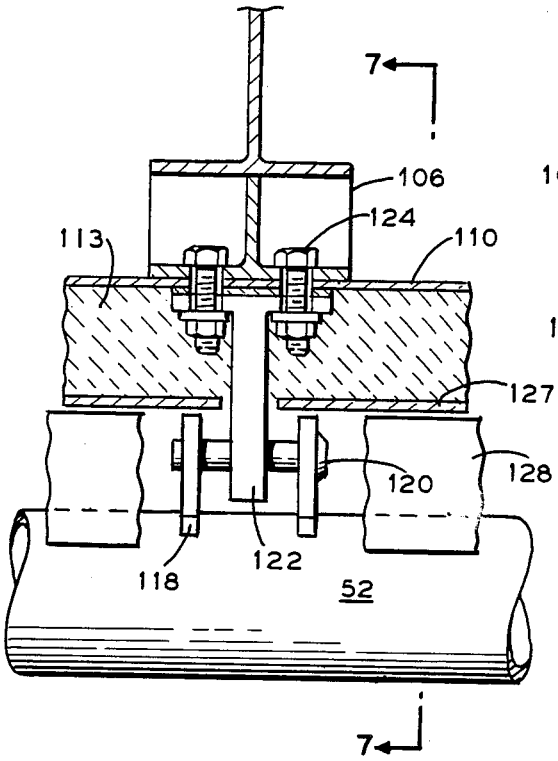
FIG. 6 is an enlarged view of the encircled part of FIG. 5, partly broken away to show additional detail, which illustrates the top supporting mechanism according to the invention.
Figure 7:
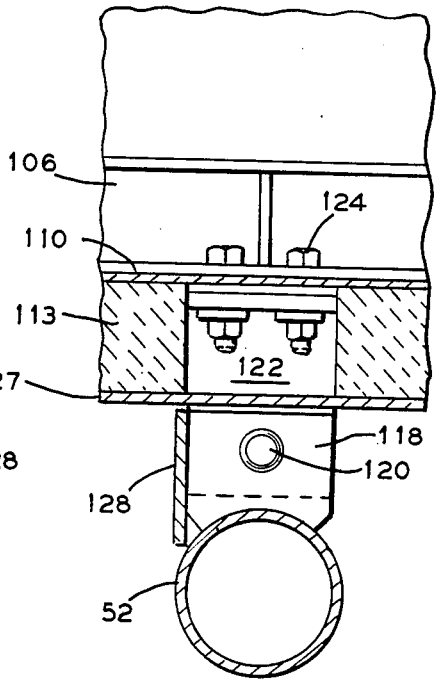
FIG. 7 is an end view partly broken away taken along Line 7—7 of FIG. 6.
Figure 8:
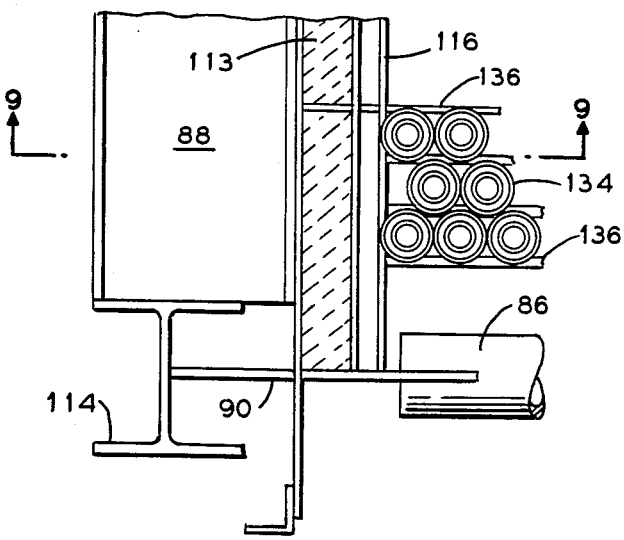
FIG. 8 is a sectional view partly broken away taken along Line 8—8 of FIG. 4.
Figure 9:
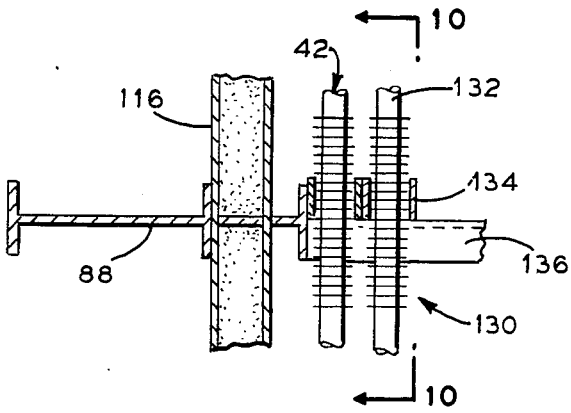
FIG. 9 is a sectional view partly broken away taken along Line 9—9 of FIG. 8.
Figure 10:
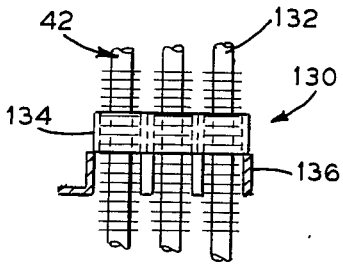
FIG. 10 is a sectional view, partially broken away, taken along Line 10—10 of FIG. 9.
Figure 11:
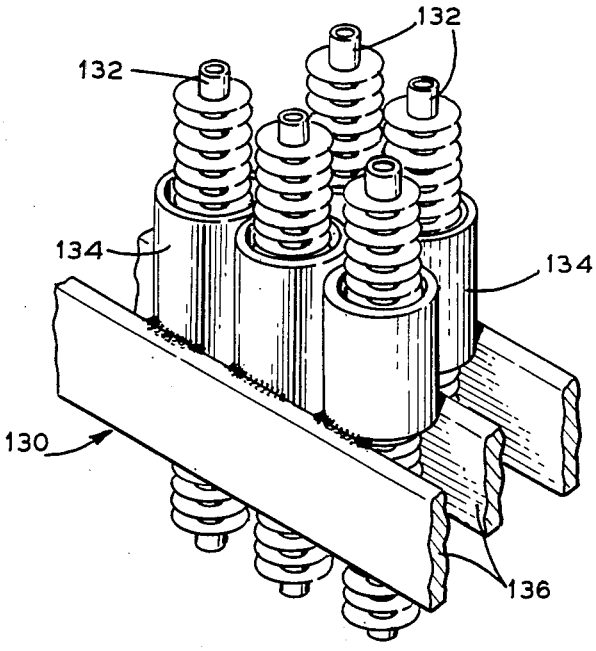
FIG. 11 is a perspective view, partially broken away, of a midspan tube bundle support.

Referring now to FIGS. 6 and 7, there are shown details of the pressure parts of sample module 22 being supported from the top structural components. A pair of spaced lug plates 118 are welded to upper header 52 and pin 120 interconnects these plates with a T-shaped support bracket 122. The lower stem of T-bracket 122 is spaced from adjacent lug plates 118 with sufficient clearance to allow for the thermal expansion/contraction of header 52. The upper flange of T-bracket 122 is connected, such as via bolts 124 to intermediate girders 106 through top casing 110, insulation 113 and insulation liner plate 127. Note that insulation 113 is inner insulation and that this inner insulation is only required where gas temperature exceeds carbon steel limits. This support arrangement operates as both a fore and aft anchor and as a shipping, handling, and operating support for tube bank 42 secured to upper header 52. A gas barrier plate 128 is attached to lug plates 118 to prevent any exhaust gas from passing between header 52 and casing 110.

FIGS. 8, 9, 10, and 11 disclose a portion of tube bank 42 and its mid-span tube support 130. The multiple tubes 132 of tube bank 42 are each circumferentially finned and disposed in a generally vertical, parallel, and staggered array. Adjacet rows of tubes 132 are generally offset by one-half the tube spacing. The ends of vertical tubes 132 are connected to horizontal upper and lower headers 52 and 32 respectively.

Mid-span tube support 130 consists of a plurality of adjacent circular tube sleeves 134 each supported on top of and secured to a series of parallel flat bars 136. Elongated finned tubes 132 extend in a slip-fit manner through sleeves 134 which provide the necessary mid-tube support during shipping and operation. The ends of parallel bars 136 are connected to horizontal mid-span supports 86 and 88, interior of side casing 116, which in turn are secured to vertical corner supports 84 or girders 114. Both sleeves 134 and bars 136 bear directly against the tube fins of tubes 132 to restrict their movement, except in the axial direction, during operation. When each module is shipped, sleeves 134 and bars 136 act as spacers between the fins to keep them properly aligned and to transfer the load from tubes 132 to the structural frame.

Figure 12:
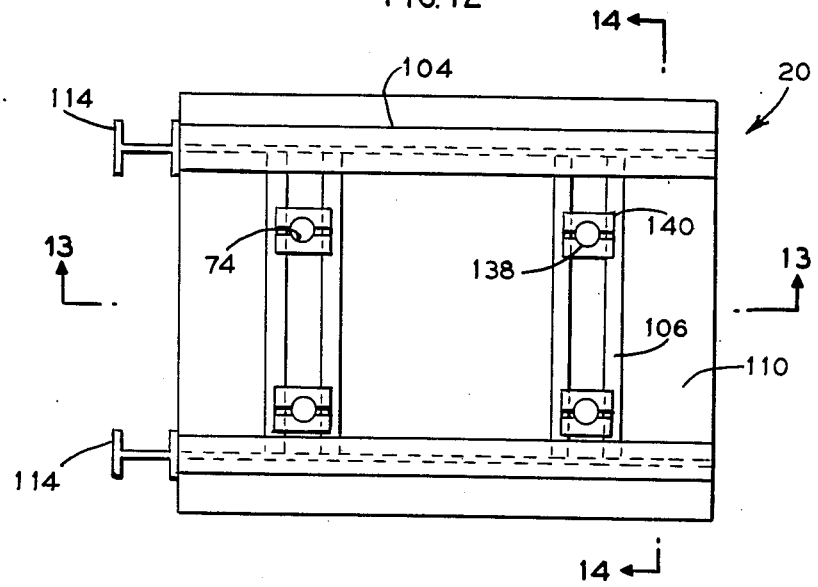
FIG. 12 is a plan view of a superheater module, partially broken away, illustrating the method of support.
Figure 13:
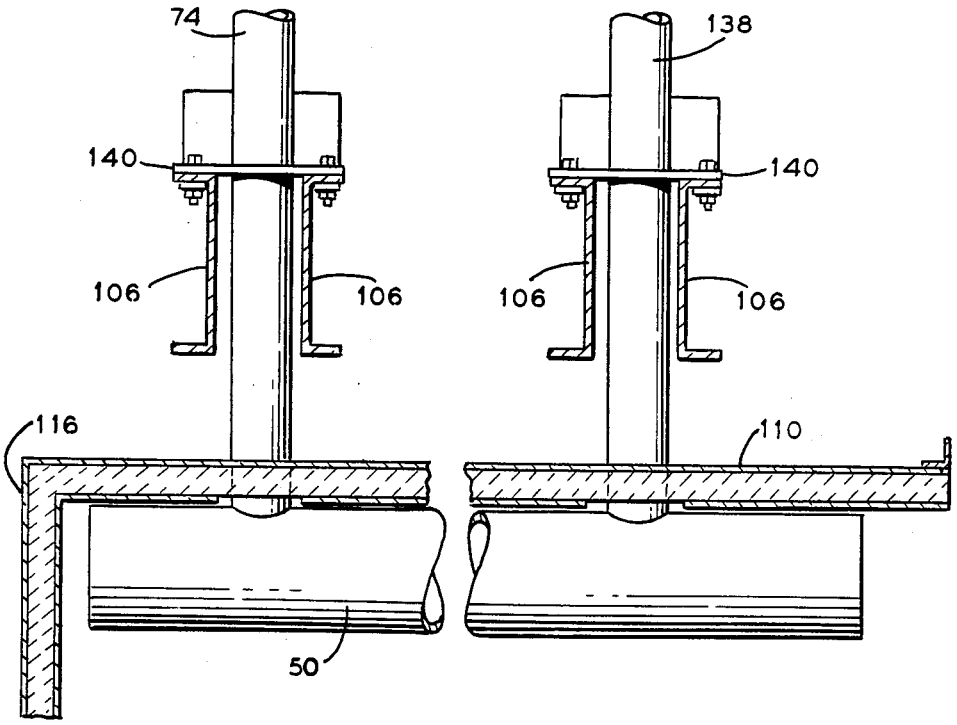
FIG. 13 is a sectional view, partially broken away, taken along Line 13—13 of FIG. 12.
Figure 14:
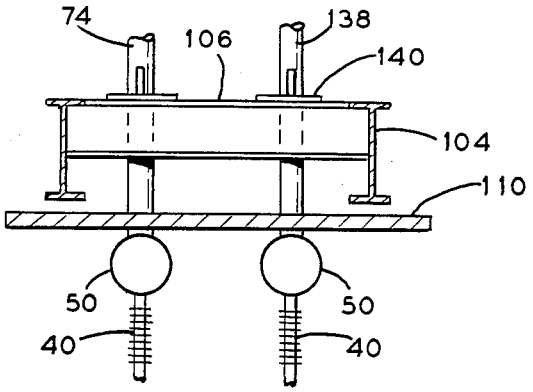
FIG. 14 is a sectional view, partially broken away, taken along Line 14—14 of FIG. 12.

Referring now to FIGS. 12, 13, and 14, separate views of superheater module 20 are shown. Generally tube banks are supported mechanically via T-bracket 122 as illustrated in FIGS. 6 and 7, but when the gas temperature inside the casing exceeds, say, 1075° F., such as in superheater module 20, tube bank 40 and header 50 are supported via connecting tubes secured to upper girders 104 and 106. As shown, superheater steam inlet 138 is secured to and passes through plate 140 which is supported by intermediate girders 106. Inlet 138 connects to upper header 50 thereby supporting it and attached tube bank 40. Similarly, superheater steam outlet 74 is supported by plates 140 on girder 106 and outlet 74 also supports header 50 and tube bank 40.

Figure 15:
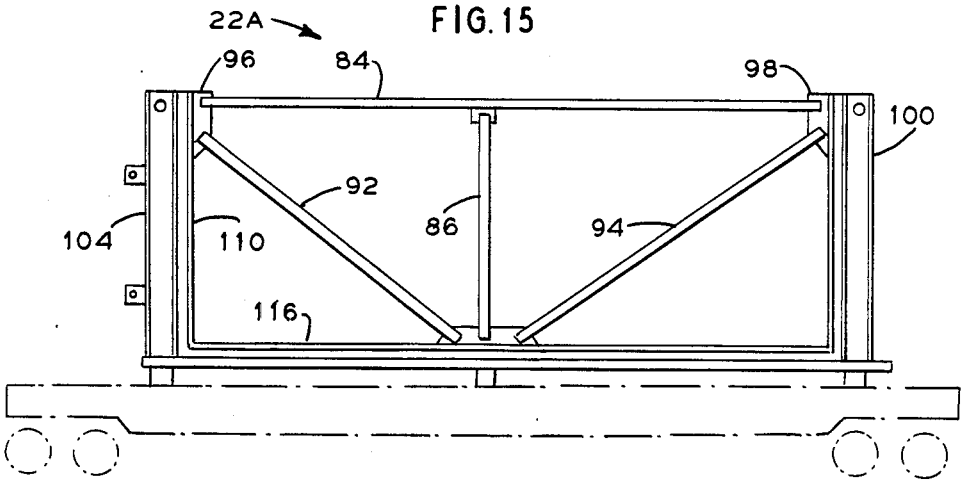
FIG. 15 is a schematic illustration of the end module of FIG. 4 mounted on a railroad flatbed.

Referring now to FIG. 15, modules constructed in accordance with the invention can be readily mounted for rail shipment without the need for any supplementary framing as has been heretofore required. As shown, the shop assembled modules 22A or 22C is supported on its side above the surface of the rail car so that the integral frame structure supports this module during shipment. These shop assembled modules are subsequently transported to the job site where they are structurally interconnected and their casings are sealed together to form a common boiler casing. This single casing permits continuous gas mixing for better temperature averaging and balance. Because the pressure parts are top supported, the need for elaborated expansion hardware on top of the boiler is eliminated. Most of the bottom connections are enclosed in the casing of the modules thereby eliminating the need for expansion hardware at the bottom of the modules.

What is claimed is:

1. A modular exhaust gas steam generator wherein each said module comprises:

(a) an open box frame through which hot exhaust gases travel, a portion of said frame being in contact with said gases;

(b) casing means fixedly secured to selected perimeter surfaces of said box frame thereby forming an integral part of said box frame for sealably closing said surface of said box frame and for retaining said gases within said box frame;

(c) tubing means extending within and nearly the height of said box frame, said tubing means being in contact with said hot gases for generating steam in said steam generator;

(d) header means within said box frame and connected to said tubing means for distributing fluid thereto, and;

(e) connecting means secured to an upper region of said box frame for top supporting said header and said tubing means;

whereby adjacent said modules are sealably secured together forming a unitary gas tight enclosure through which exhaust gases travel.

2. A steam generator as set forth in claim 1 wherein said box frame is elongated and comprises bracing means interior of said casing means and in contact with said exhaust gases for bracing said open box frame.

3. A steam generator as set forth in claim 2 wherein said elongated box frame is generally rectangular having upper and lower support members.

4. A steam generator as set forth in claim 3 wherein a said casing segment is secured to each of said upper and lower support members.

5. A steam generator as set forth in claim 4 wherein said tubing means comprise a spaced array of circumferentially finned tubes.

6. A steam generator as set forth in claim 5 wherein said tubes extend generally vertically in parallel rows within said box frame.

7. A steam generator as set forth in claim 6 wherein adjacent said rows are offset one from the other by a distance of approximately one-half of the tube spacing in said rows.

8. A steam generator as set forth in claim 7 further comprising a tube support secured to said box frame for supporting and aligning said tubes.

9. A steam generator as set forth in claim 8 wherein said tube support comprises a series of adjacent tube sleeves sized to slidably fit around said circumferentially finned tubes permitting said tubes to move axially while restricting the side ways movement of said tubes.

10. A steam generator as set forth in claim 9 wherein said header means comprises upper and lower horizontally extending headers connected to opposite ends of said tubes.

11. A steam generator as set forth in claim 10 wherein said connecting means comprise at least one moveable connection between said box frame and said upper headers.

12. A steam generator as set forth in claim 11 wherein said moveable connection comprises at least one lug plate secured to a said upper header and a bracket secured to a said upper support member.

13. A steam generator as set forth in claim 12 wherein said casing means further comprises a side plate secured to and sealably closing a side region of said box frame.

14. A top-supported steam generator module comprising:

(a) a generally rectangular support frame comprising:
  (1) vertical corner supports extending in parallel relationship in respective corners of said rectangular frame;
  (2) bracing means secured to adjacent said vertical corner supports for bracing said support frame;
  (3) an upper supporting frame rigidly connected to the upper region of said corner supports;
  (4) a lower supporting frame rigidly connected to the lower region of said corner supports; and
  (5) brace members on at least two sides of said rectangular frame, connecting between adjacent said vertical corner supports;

(b) horizontally extending upper and lower headers and a tube bank including vertically extending rows of tubes disposed in a generally parallel, spaced array, each of said tubes being connected at opposite ends to said horizontally extending upper and lower headers;

(c) an upper casing secured to said upper supporting frame and a lower casing secured to said lower supporting frame for sealably closing the upper and lower ends of said rectangular frame, and;

(d) top supporting means secured to said upper supporting frame for supporting said upper header whereby said means support the weight of said tube bank.

15. A top-supported steam generator module as set forth in claim 14 wherein said vertically extending rows of tubes are circumferentially finned and extend in a staggered array with each said row of tubes being offset from the next by one-half of a tube pitch, said tubes being supported by a mid-span tube support secured to said rectangular frame.

16. A top-supported steam generator module as set forth in claim 15 wherein said mid-span tube support comprises a series of adjacent tube sleeves sized to snuggly fit around said circumferentially finned tubes.

17. A top-supported steam generator module as set forth in claim 16 wherein said top supporting means further comprises at least one lug plate secured to each of said upper headers and a bracket moveably secured to said plate and rigidly secured to said upper support frame.

18. A top-supported steam generator module as set forth in claim 17 further comprising at least one side casing sealably secured between adjacent vertical corner supports for closing a side of said rectangular frame.

* * * * *